US005799589A

United States Patent [19]

Clark

[11] Patent Number: 5,799,589

[45] Date of Patent: Sep. 1, 1998

[54] UNITARY COUNTERTOP AND DEAL TRAY ASSEMBLY

[76] Inventor: Larry G. Clark, 6215 Red Alder Dr., Plainfield, Ind. 46168

[21] Appl. No.: 784,032

[22] Filed: Jan. 15, 1997

[51] Int. Cl.[6] ..... E06B 7/32

[52] U.S. Cl. ..... 109/19; 232/43.1

[58] Field of Search ..... 109/10–19; 232/43.1

[56] References Cited

U.S. PATENT DOCUMENTS

| | | | |
|---|---|---|---|
| 172,859 | 8/1876 | Belew . | |
| 344,841 | 3/1886 | Rogers et al. . | |
| 936,551 | 10/1909 | Moore . | |
| 1,458,202 | 2/1923 | Stout . | |
| 1,885,165 | 11/1932 | Willems | 109/19 |
| 2,648,300 | 8/1953 | Beedle | 109/19 |
| 3,145,918 | 8/1964 | Higgins et al. | 109/19 |
| 3,298,329 | 1/1967 | Carstens, Jr. et al. | 109/10 |
| 3,429,082 | 2/1969 | Strickland et al. . | |
| 3,682,113 | 8/1972 | McClellan et al. | 109/19 |
| 4,084,149 | 4/1978 | Driver et al. | 109/19 |
| 4,393,789 | 7/1983 | Glotfelter . | |
| 4,517,901 | 5/1985 | Clark . | |
| 4,596,358 | 6/1986 | Hagberg | 232/43.1 |
| 4,640,200 | 2/1987 | Richardson . | |
| 5,615,624 | 4/1997 | Terry et al. | 109/19 |

FOREIGN PATENT DOCUMENTS

| | | | |
|---|---|---|---|
| 1509671 | 6/1969 | Germany | 109/17 |
| 589211 | 6/1977 | Switzerland | 109/19 |
| 0609126 | 2/1979 | Switzerland | 109/19 |
| 1587410 | 4/1981 | United Kingdom | 109/19 |

*Primary Examiner*—Darnell M. Boucher

*Attorney, Agent, or Firm*—Woodard, Emhardt, Naughton Moriarty & McNett

[57] ABSTRACT

A unitary countertop and deal tray assembly comprises a drawer mounted within a countertop. The assembly is for business transactions through a barrier, such as a building wall, illustrated as a bulletproof cashier window for example. The assembly is pre-fabricated for installation in an opening in the barrier. The countertop has an opening in the top face of the countertop on the cashier (internal) side of the window, and an opening in the front face of the countertop on the customer (external) side of the window. The drawer is movably mounted within the countertop, and is normally in an assembly-closed position where the drawer is open and its interior is accessible through the internal opening in the countertop while the front end of the drawer is adjacent or flush with the front face of the countertop, whereby the drawer interior is inaccessible from the customer side. The drawer is movable by the cashier to an open position where the front end projects beyond the front face of the countertop for access to the interior of the drawer by the customer. The projection of the countertop out from the barrier, with the countertop top surface uninterrupted by the drawer, provides a relatively large working area for a prospective customer to use the countertop to prepare a transaction before placing it in the drawer.

16 Claims, 5 Drawing Sheets

UNITARY COUNTERTOP AND DEAL TRAY ASSEMBLY

BACKGROUND OF THE INVENTION

This invention relates generally to drawers such as those used by cashiers for through-the-wall transactions with customers, and more particularly to a drawer assembly unitary or integrated with a countertop.

There are a few patents of which I am aware that show deal drawers or deal trays. One is U.S. Pat. No. 4,640,200 to Richardson. That patent discloses a pass-through transaction drawer to permit a transaction between a customer outside a building with an attendant inside the building. It consists of a deal tray that mounts within a wall and therefore is likely simple for an architect to identify in the designs for a building. However, any work space for the customer to use outside the building is absent and therefore requires an architect to prepare separate and expensive design details for a contractor to properly install a usable work space.

A second of which I am aware is U.S. Pat. No. 4,393,789 to Glotfelter. That patent also discloses a pass-through transaction drawer or deal tray for use between an inside attendant and an outside customer. This particular unit appears to mount flush with the wall and, similar to that identified above, is likely simple for an architect to identify in the designs for a building. However, here again any work space for the customer is absent and therefore requires an architect to prepare separate and expensive design details in order for the workplace to be included in the construction of the building.

A third patent of which I am aware is U.S. Pat. No. 936,551 to Moore. Unlike the first two, this patent discloses an entire booth with deal trays and a shelf. However, its deal tray and shelf lack any type of unitary or integrated structure. Hence, just like the previous two examples, the drawer in the Moore reference also requires separate design details for the architect to include a shelf in the design. In other words, the architect cannot simply identify a particular deal tray and be insured that a shelf area will be properly installed by the contractor.

Therefore, there is a need for a combination deal tray and a usable work space or countertop which can be readily prefabricated and identified by an architect in the designs of a building without the need for the architect to also provide additional and expensive design details. This invention addresses that need.

SUMMARY OF THE INVENTION

Briefly describing one aspect of the present invention, a combination of a drawer having a front and a barrier having a first and a second side with an opening through the barrier is described. The combination further includes a countertop mounted within the opening in a fashion that the countertop projects out from the first side of the barrier. The countertop has a top face and a front face and further has an external opening in the front face that is positioned on the first side of the barrier and an internal opening that is positioned on the second side of the barrier. Continuing with one aspect of the present invention, the drawer is mounted to move internally within the countertop between a first position where the drawer is open to the internal opening of the countertop and the front end of the drawer is adjacent the front face of the countertop and a second position where the front end projects beyond the front face of the countertop.

Briefly describing another aspect of the present invention, a deal tray for transactions through a barrier is described.

The deal tray includes a countertop with a top face and a front face, and further includes an external opening in the front face and an internal opening in the top face. The deal tray further includes a drawer that has a front end which is both movably and internally mounted within the countertop. The drawer moves between a first position where the drawer is open to the internal opening of the countertop and the front end of the drawer is adjacent the front face of the countertop and a second position where the front end projects beyond the front face of the countertop.

Briefly describing still another aspect of the present invention, a building is described for transactions between a clerk on the inside of the building and a customer on the outside of the building. The building includes a barrier that has an opening formed therethrough. Mounted within the opening of the barrier, the building includes a countertop with a top face and a front face, with the countertop further having an external opening in the front face on the first side of the barrier and an internal opening on the second side of the barrier. The countertop is mounted projecting beyond the barrier so as to provide a work space above the external opening on the first side of the barrier whether the drawer, described below, is open or closed. The security booth also includes a drawer that has a front end and which is internally mounted within the countertop and is movably mounted between a first position where the drawer is open to the internal opening of the countertop and the front end of the drawer is adjacent the front face of the countertop and a second position where the front end of the drawer projects beyond the front face of the countertop.

An object of this invention is to provide a unitary combination of a countertop and deal tray, in other words a deal tray that is integrated with a countertop.

An advantage of this invention is that it can be identified by an architect and installed by a contractor without the creation of expensive and complicated design details for a contractor to install the invention.

A feature of this invention is that it can be prefabricated and ready for installation prior to arriving at the construction site.

These and other objects, advantages or features of the invention will become more apparent from the following description of the preferred embodiment.

BRIEF DESCRIPTION OF THE DRAWINGS

In the accompanying drawings, forming a part of this specification, and in which like numerals are employed to designate like parts throughout the patent.

DESCRIPTION OF THE PREFERRED EMBODIMENT

Figure 1:
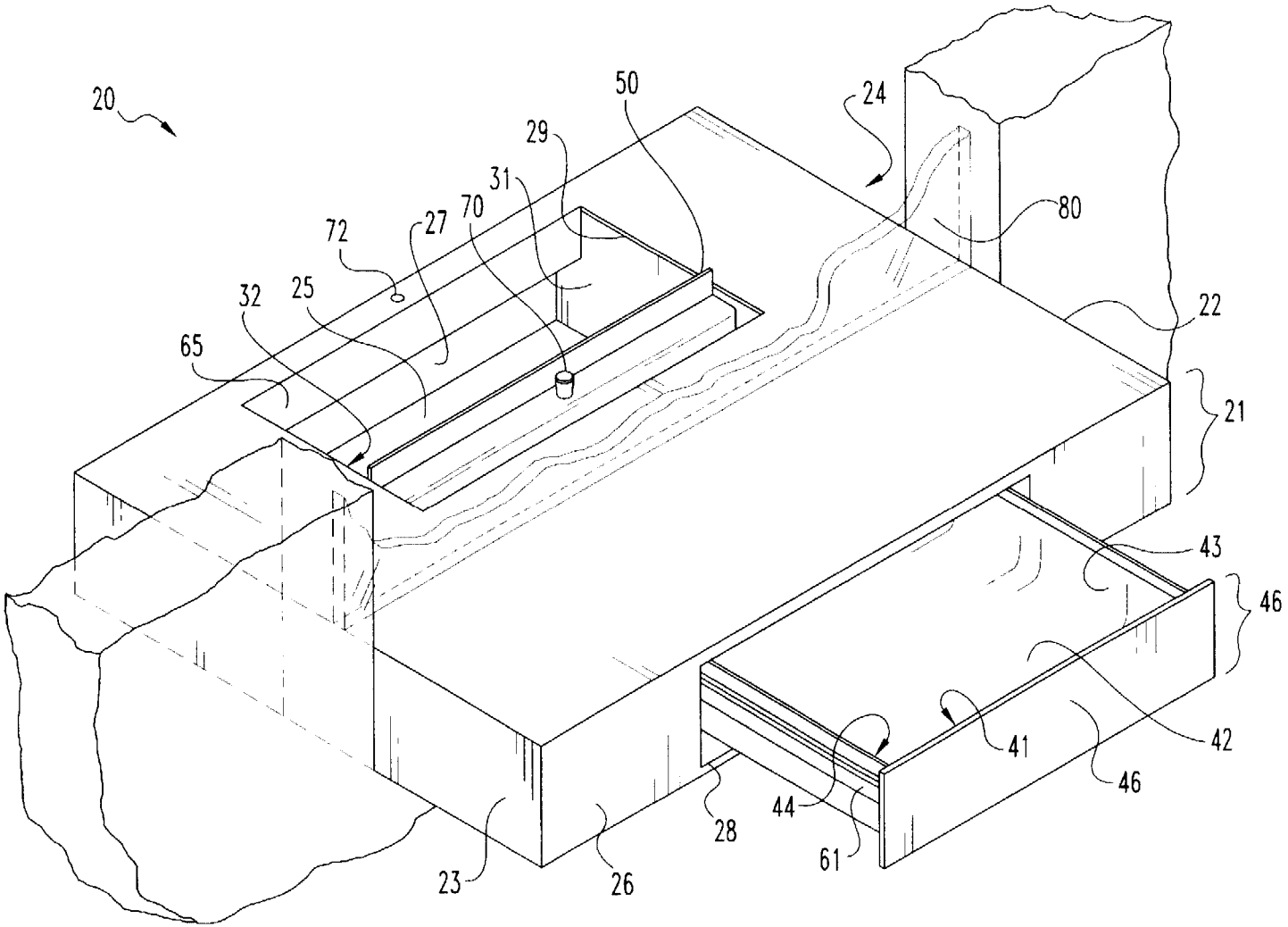
FIG. 1 is a perspective view of the unitary countertop and deal tray with the drawer open and showing the proper placement of a barrier in a building (the entire building is not shown).

For the purposes of promoting an understanding of the principles of the invention, specific language is used to describe the embodiments of this invention that are illustrated in the drawings. Please understand that no limitation of the scope of the invention is intended by this description. Any alterations and modifications to the illustrated method as well as further applications of the principles of the invention that would normally occur to one of average skill in this art are included.

As used within this specification the term, "adapted" means to make fit as for a specific use or situation.

As used within this specification the term, "adjacent" means not distant; i.e. being nearby or even having a common endpoint or border.

As used within this specification the term, "barrier" means a material object or set of objects that separates, demarcates, or serves as a barricade.

As used within this specification the term, "building" means a roofed and walled structure built for permanent use.

As used within this specification the term, "combination" means a result or product of combining.

As used within this specification the term, "countertop" means flat working surface.

As used within this specification the term, "drawer" means a sliding box or receptacle opened by pushing out and closed by pulling in.

As used within this specification the term, "end" means a point that marks the extent of something.

As used within this specification the term, "external" means of, relating to, or connected with the outside or an outer part; or applied or applicable to the outside.

As used within this specification the term, "face" means any of the plane surfaces that bound a geometric solid.

As used within this specification the term, "flush" means having or forming a continuous plane or unbroken surface; directly abutting or immediately adjacent.

As used within this specification the term, "front" means the side that contains the principal entrance.

As used within this specification the term, "improvement" means something that enhances value or excellence.

As used within this specification the term, "interior" means lying, occurring, or functioning within the limiting boundaries.

As used within this specification the term, "internal" means of, relating to, or occurring within the confines of an organized structure.

As used within this specification the term, "mountable" means to attach to a support.

As used within this specification the term, "movably" means capable of being moved.

As used within this specification the term, "partition" means something that divides; such as an interior dividing wall.

As used within this specification the term, "project(s)" means to cause to protrude.

As used within this specification the term, "top" means the highest or uppermost region or part; the upper end, edge or surface; a fitted, integral, or attached part or unit serving as an upper piece, lid or covering.

Referring now to the drawings in detail, FIG. 1 depicts a preferred example of the countertop and deal tray assembly

20 when it is in a second or open position according to the principles of this invention. The feature most easily noted is countertop 21. Countertop 21 may be understood as a frame or housing formed from a top face 22, two sides 23 and 24, a bottom 25, a front face 26, and a back face 27. Countertop 21 may be constructed from many materials including those materials that may be exposed to the elements of weather, such as stainless steel or fiber-reinforced plastics. For example, a highly preferably material is 16 or 10 gauge stainless steel.

Figure 2:
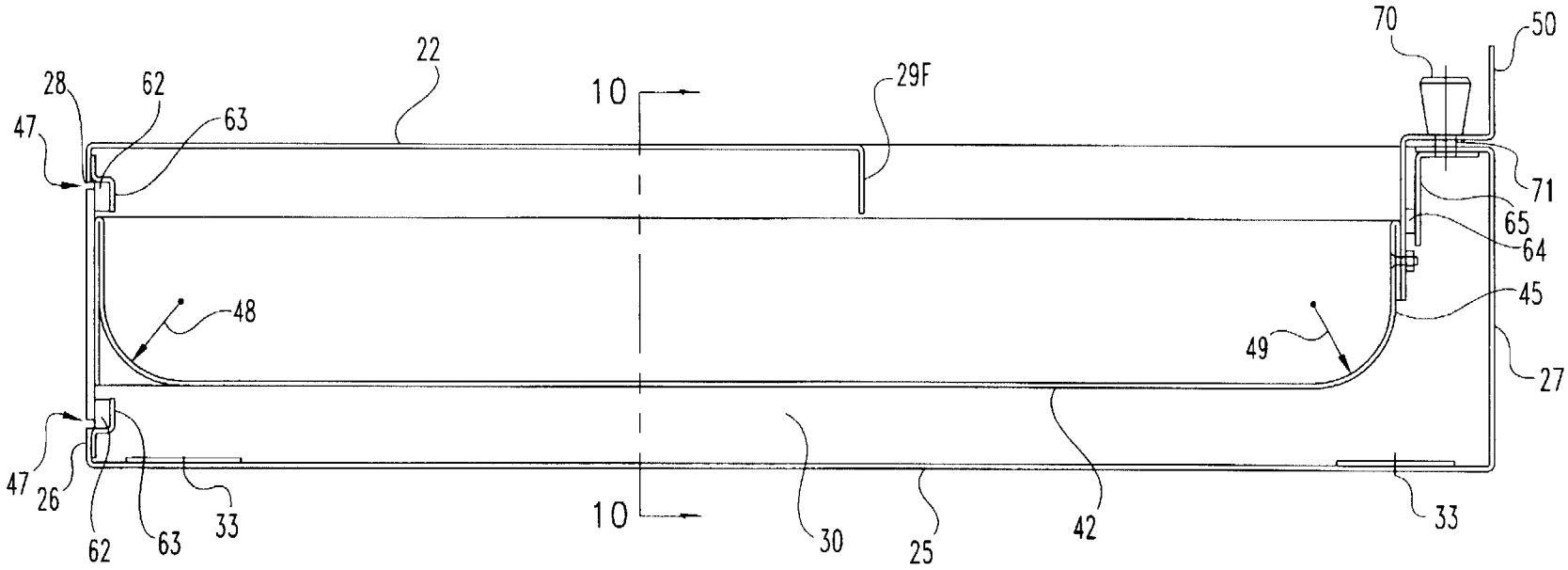
FIG. 2 is a side elevational view of a cross-section with the drawer fully closed.
Figure 5:
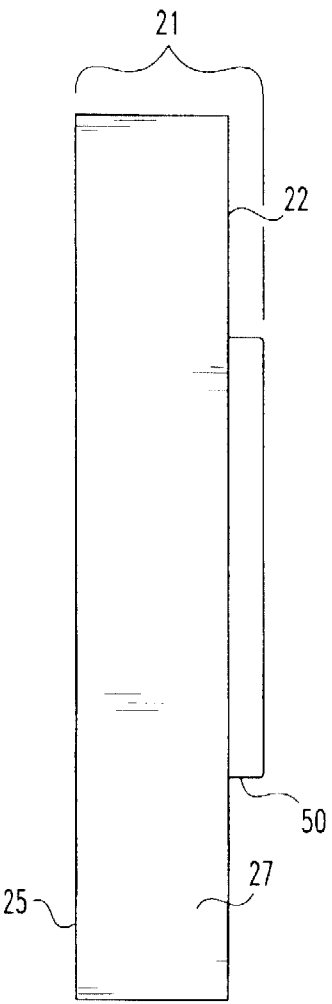
FIG. 5 is a rear view with the drawer fully closed.
Figure 4:
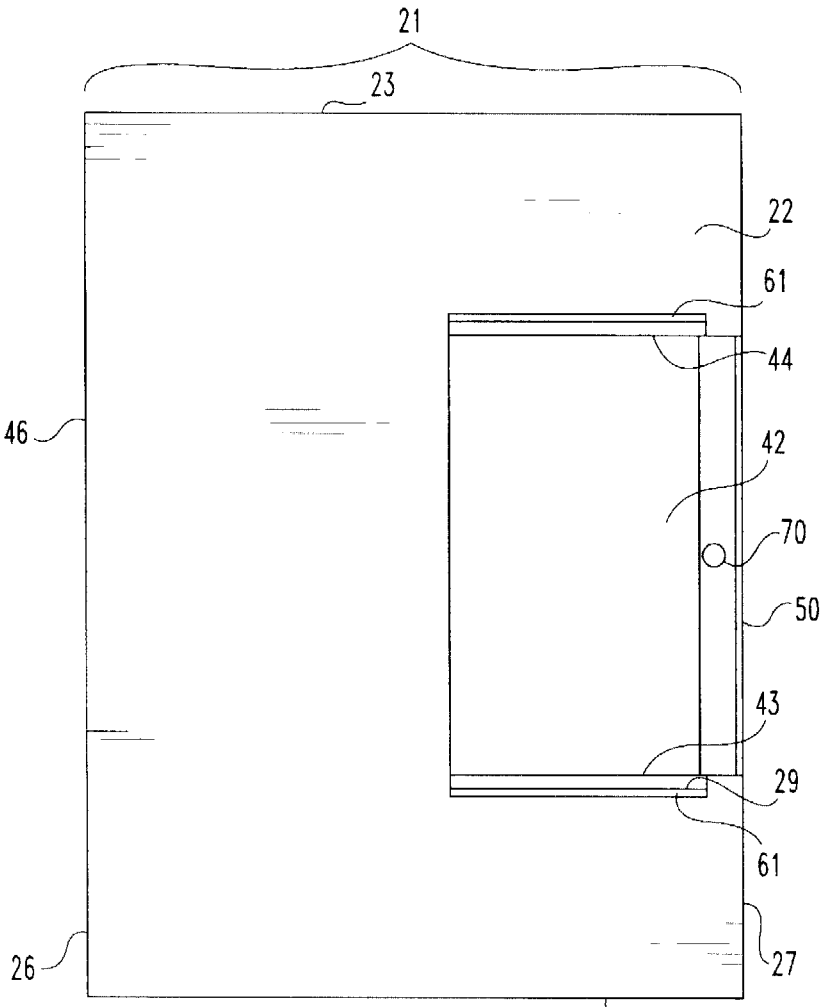
FIG. 4 is a top view with the drawer fully closed.
Figure 3:
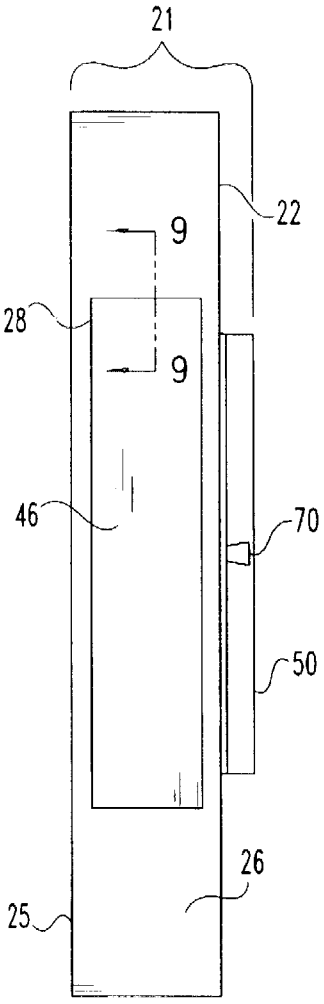
FIG. 3 is a front elevational view with the drawer fully closed.
Figure 8:
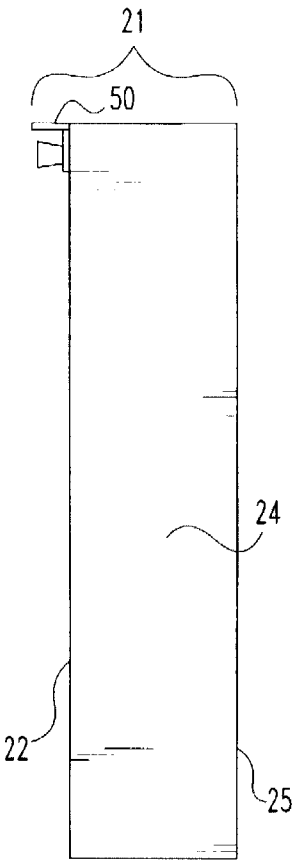
FIG. 8 is another side view with the drawer fully closed.
Figure 7:
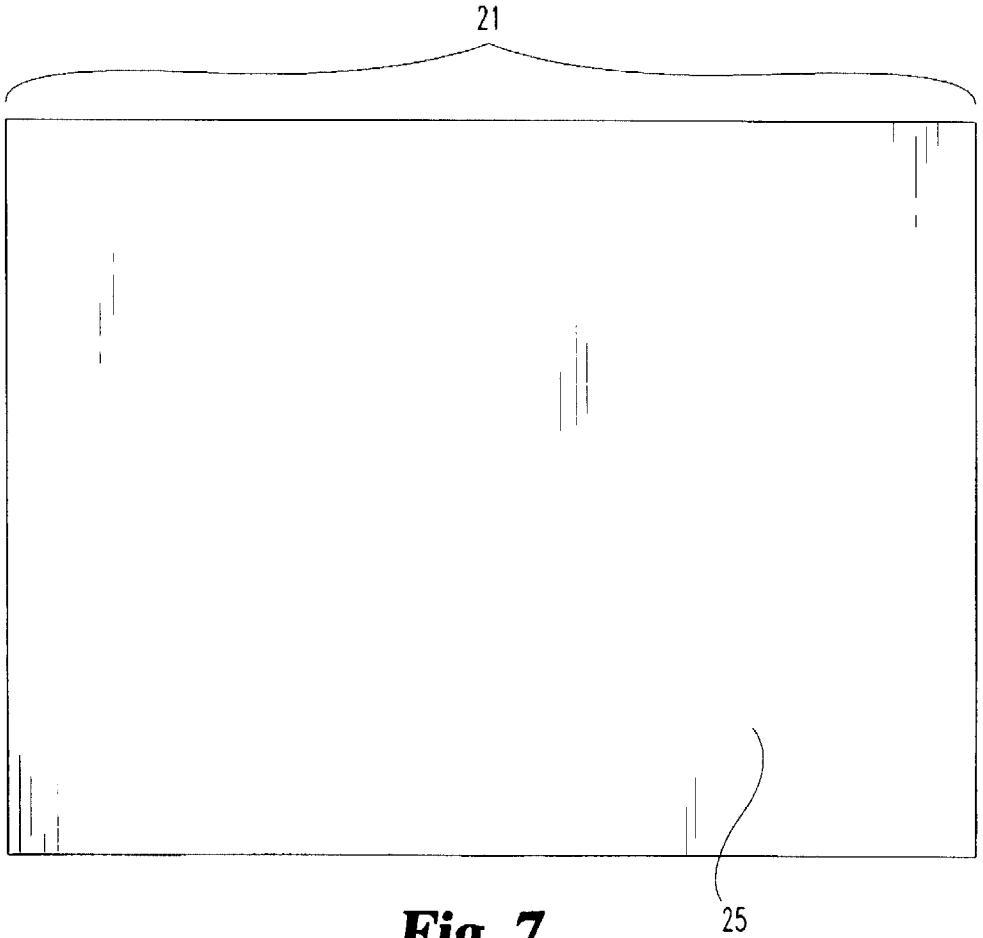
FIG. 7 is a bottom view with the drawer fully closed.
Figure 6:
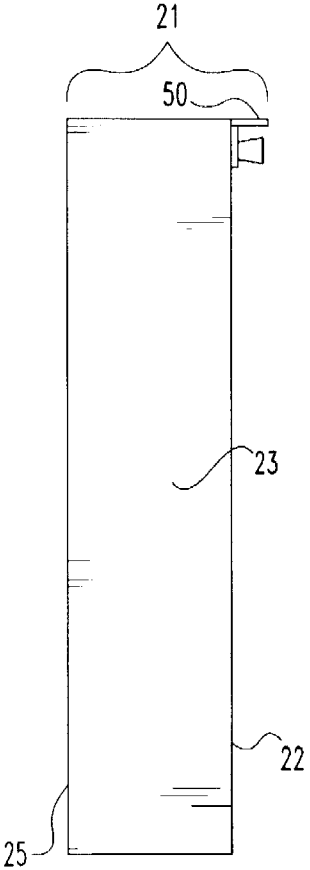
FIG. 6 is a side view with the drawer fully closed.

Countertop 21 further includes an external opening 28 and an internal opening 29. Referring to FIG. 2, a passageway 30, internal to the assembly 20, resides between external opening 28 and internal opening 29. Passageway 30 is preferably bounded by bottom 25, top face 22, and (referring back to FIG. 1) two partitions 31 and 32. Partitions 31 and 32 preferably extend from front face 26 to back face 27, and similar to countertop 21, are preferably constructed from weatherable materials like 16 or 10 gauge stainless steel. These partitions are attached in any suitable fashion and, depending on the material, include both welding or machine screws or bolts. Example seams and/or points of attachment are generally identified in the drawings at 33.

Another most easily noted feature of assembly 20 is drawer 40. Drawer 40 includes an open top, a front end 41, a drawer bottom 42, drawer sides 43 and 44, and a rear end 45. Preferably, rear end 45, drawer bottom 42 and front end 41 are formed from a continuous sheet of material with radii 48 and 49 between them. Preferably, attached to front end 41 is face plate 46. When drawer 40 is in a first or closed position, face plate 46 is preferably aligned flush with front face 26 (see FIGS. 2 and 9) and in a manner that minimizes gap 47 between the two. Continuing the description, a rear pull 50 is preferably attached to rear end 45 and preferably extends through internal opening 29. Similar to the countertop element of this invention, drawer 40 may be constructed from many materials, including those that may be exposed to the elements, such as stainless steel or fiber reinforced plastics.

Drawer 40 is movably mounted within countertop 21 and within passageway 30. Drawer 40 moves between a first or closed position where drawer 40 is accessible through internal opening 29 (see FIGS. 2–8) and a second or open position where the drawer is accessible as front end 41 projects beyond front face 26 (see FIG. 1). In the closed position, front end 41 is adjacent, or preferably nearly flush, with front face 26 so as to prevent access through external opening 28. In a most preferred embodiment, face plate 46 is utilized and resides flush with front face 26 when drawer 40 is in the closed position.

Figure 10:
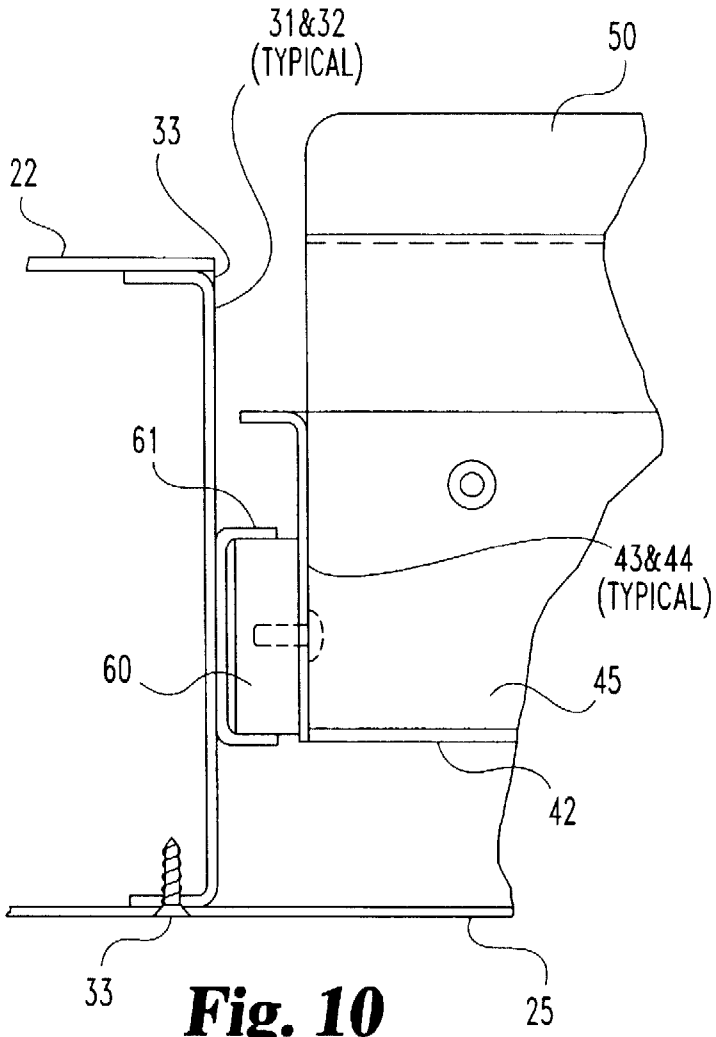
FIG. 10 is an enlarged fragmentary sectional view of the drawer and countertop.

In one preferred embodiment, drawer 40 is movably mounted on a bearing-channel arrangement. For example and referring to FIG. 10, two or more UHMW (ultrahigh molecular weight) bearings 60 are rotatably mounted on pins to each side of drawer 40, on drawer sides 43 and 44. Continuing the embodiment, channel 61 is mounted to each partition 31 and 32. Drawer 40 is then placed inside countertop 21 with bearings 60, now located on each side of drawer 40, engaging a channel 61 that is located on each side of drawer 40. In this fashion, drawer 40 smoothly glides between the open and closed positions as bearings 60 roll inside channels 61. In another embodiment, not shown, the bearings may be mounted to partitions 31 and 32 and the channel may be mounted to drawer sides 43 and 44. Bearings 60 are preferably constructed from any ultra high molecular weight polymer. Other bearing-channel assemblies well known in the art are also contemplated for use with this invention, for example, the use of roller or ball bearings with channel.

Figure 9:
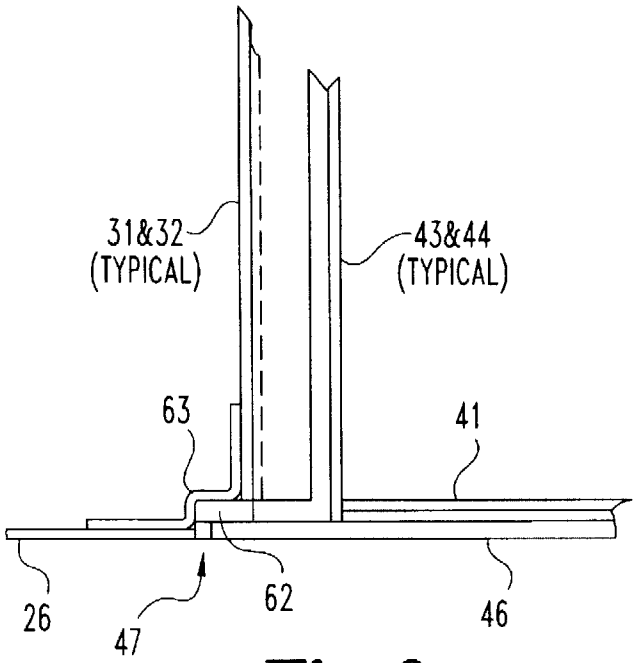
FIG. 9 is an enlarged fragmentary sectional view of the front of the countertop and the front end of the drawer.

In another preferred arrangement, several bumpers are included to absorb any shock caused by closing drawer 40 within countertop 21. Referring first to FIGS. 2 and 9, a bumper 62 is preferably mounted in external opening 28, between face plate 46 and countertop 21. As shown, this may be done with an elongate clip 63. Mounted in this fashion, as drawer 40 closes, face plate 46 strikes bumper 62 before hitting countertop 21. Bumper 62 may be fabricated from any elastic material, and is preferably manufactured from a natural rubber or a silicone rubber. Furthermore in this fashion, bumper 62 serves as a seal preventing weather elements from penetrating into drawer 40 when the assembly is in the closed position. Referring next to FIG. 2, a rear bumper 64 is also preferably included in this invention. Rear bumper 64 is mounted to bracket 65 and further serves to absorb shock created as one may close the assembly.

A final aspect of the present invention is spring loaded plunger 70. Referring again to FIG. 2, spring loaded plunger 70 is mounted within rear pull 50. When drawer 40 is in the closed position, stud 71, which is telescopically mounted within spring loaded plunger 70, is forced downward by a spring within plunger 70 (not shown) to engage opening 72 in countertop 21. When ready to open drawer 40, one simply pulls upward on the knob of spring loaded plunger 70 which compresses the internal spring and pulls stud 71 from opening 72 into plunger 70. It is further preferable that spring loaded plunger 70 has a hold-open feature. This feature allows stud 71 to be held in an up position by pulling the knob of spring loaded plunger 70 up and partially turning it in place. Once turned, the internal spring is held in compression and stud 71 remains within spring loaded plunger 70. In this fashion, a clerk operating drawer 40 need not routinely lock and unlock drawer 40 for multiple transactions. However, at the close of business, drawer 40 is easily relocked by turning the knob on plunger 70 in the reverse direction to allow the internal spring to expand and force stud 71 into opening 72. Such spring loaded plungers with a hold-open feature are widely known in this art and are commercially available.

Referring to FIG. 1, the countertop deal tray assembly 20 is mounted within a building by placing assembly 20 in an opening in one of the barriers or walls of the building, identified as item 80. Barrier 80 is preferably a clear but bulletproof material that allows one to see from the internal side of the booth to the external side and vice versa. Barrier 80 is preferably placed near the front edge 29F of opening 29 so as to maximize the countertop space above drawer 40 for a prospective customer. For example, in a countertop that is overall 18" deep, from front face to back face, typically at least 8" would be allowed for the countertop to extend beyond barrier 80. Furthermore, it would be preferable for countertop 21 to have a width substantially wider than the drawer inside it. For example, given a drawer that is 12" wide, it would be preferable to use a countertop that is 24" wide from side 23 to side 24, so as to offer a countertop that is 100% wider than the drawer inside it. In other embodiments, the countertop may be something only 10% or more wider than the drawer inside it. In yet another embodiment, the countertop may be more than 100% wider than the drawer inside it. And still yet in another embodiment, the countertop may be more than 200% wider than the drawer inside it. An example of this last embodiment would be a countertop that measures over 36" from side 23 to side 24 while the drawer is only 12" wide.

While the invention has been illustrated and described in detail in the drawings and description, these are to be considered as illustrative and not restrictive. It must be understood that only a preferred embodiment has been shown and described and that all changes and modifications that come within the spirit of the invention are included where described by the following claims.

I claim:

1. For the combination of a drawer having a front end and a barrier that is at least partially transparent and has an external side and an internal side and has an opening formed therethrough, the improvement comprising:

a countertop mountable within said opening wherein said countertop will project out from the external side of the transparent portion of said barrier and provides a work space external to the transparent portion, said countertop having a top face and a front face and an interior, said countertop having an external opening in said front face, said countertop having an internal opening, and wherein said drawer is movably mounted within said interior of said countertop between a first position where said drawer is open to the internal opening of said countertop and the front end of said drawer is adjacent the front face of said countertop and a second position where said front end projects beyond the front face of said countertop.

2. The combination of claim 1, wherein said internal opening is in said top face.

3. The combination of claim 1, wherein said countertop projects at least 6" beyond the external side of the transparent portion of said barrier.

4. The combination of claim 1, wherein said countertop is more than 10% wider than said drawer.

5. A deal tray assembly for transactions between a location in front of a barrier and a location behind a barrier, comprising:

a countertop having a top face and a front face and further having an external opening in the front, an internal opening, and an interior, said countertop adapted to be received in a barrier, whereby said countertop provides a work space above said external opening, on said top face, between the barrier and the external opening; and a drawer having a front end, said drawer being movably mounted within said interior of said countertop between a first position where said drawer is open to the internal opening of said countertop and the front end of said drawer is adjacent the front face of said countertop and a second position where said front end projects beyond the front face of said countertop.

6. The deal tray assembly of claim 5, wherein said internal opening is in the said top face.

7. The deal tray assembly of claim 5, wherein said countertop projects at least 6" beyond said internal opening toward said front face.

8. The deal tray assembly of claim 5, wherein said countertop is more than 10% wider than said drawer.

9. A building, comprising:

a wall having an external side and an internal side and having an opening formed there through with a bottom and opposite sides, the wall extending laterally and downwardly from the sides and bottom, respectively, of the opening;

a countertop mounted within the opening in said wall;

a barrier extending upward from the countertop and having a transparent portion, the countertop projecting out from the barrier, said countertop having a top face and a front face and further having an external opening in the front face, an internal opening, and an interior;

whereby said countertop provides a work space above said external opening, on said top face, between the barrier and the external opening; and a drawer having a front end, said drawer movably mounted within said interior of said countertop between a first position where said drawer is open to the internal opening of said countertop and the front end of said drawer is adjacent the front face of said countertop and a second position where said front end projects beyond the front face of said countertop.

10. The building of claim 9, wherein said internal opening is in said top face.

11. The building of claim 9, wherein said countertop projects at least 6" beyond said barrier towards said front face.

12. The building of claim 9, wherein said countertop is more than 10% wider than said drawer.

13. The building of claim 9, wherein said transparent portion of the barrier contacts said countertop.

14. The building of claim 13, wherein the horizontal depth of said drawer is at least half of the horizontal depth of said countertop.

15. The assembly of claim 5, wherein said countertop is further adapted to contact and close the sides and bottom of an opening in the barrier and to contact a transparent barrier with the countertop.

16. The assembly of claim 5, wherein the horizontal depth of said drawer is at least half of the horizontal depth of said countertop.

* * * * *